United States Patent [19]

Webby

[11] 4,317,333

[45] Mar. 2, 1982

[54] REMOTE WATER COOLED HEAT ENGINE

[76] Inventor: Charles W. Webby, 218 Crawford Rd., Gisborne, New Zealand

[21] Appl. No.: 927,759

[22] Filed: Jul. 25, 1978

[51] Int. Cl.[3] ..... F01K 25/06

[52] U.S. Cl. ..... 60/649; 60/673

[58] Field of Search ..... 60/649, 673, 674

[56] References Cited

U.S. PATENT DOCUMENTS

| | | | |
|---|---|---|---|
| 726,770 | 4/1903 | Siple | 60/674 |
| 770,468 | 9/1904 | Lake | 60/674 |
| 3,972,195 | 8/1976 | Hays | 60/649 |

*Primary Examiner*—Allen M. Ostrager

*Attorney, Agent, or Firm*—Holman & Stern

[57] ABSTRACT

A method of operating a heat engine where heated gas is introduced into a venturi or a convergent/divergent nozzle. The heated gas is cooled in a low pressure region by fluid injection the resultant mixture then being passed through the divergent or diffuser part of the venturi or nozzle to a working apparatus. A heat engine is also disclosed which operates according to this method which includes a heat source coupled to a venturi or convergent/divergent nozzle. The nozzle can be substituted by a loop or cyclone. Means are provided to inject fluid into the gas stream in the nozzle loop or cyclone.

16 Claims, 3 Drawing Figures

REMOTE WATER COOLED HEAT ENGINE

BACKGROUND OF THE INVENTION

1. Field of the Invention

This invention relates to a heat engine.

2. Description of the Prior Art

Heat engines are known which operate on a Brayton or constant pressure cycle. That is an engine which operates with a compressor and expander where air from a compressor is fed to a heater where it is heated at constant pressure. The heated air is then fed to an expander and from the expander to a cooler where it is cooled at constant pressure. The cooled air is returned to the compressor to complete the cycle. This cycle is of course the basis of operation of a gas turbine where a rotary compressor and turbine are used.

My present invention relates to a heat engine using such a cycle but aims to dispense with the requirement of a turbine/compressor or expanding cylinder/compressor for the expansion and compression phases of the cycle.

SUMMARY OF THE INVENTION

Broadly the invention can be said to consist of a method of operating a heat engine wherein heated gas is introduced into a venturi of converging/diverging nozzle, the heated gas is then cooled in the low pressure region by fluid injection the resulting mixture then passing through the divergent or diffuser part of the venturi or nozzle to a working area.

According to a second broad aspect of the invention the invention consists of a heat engine comprising a heat source for gas, a venturi or converging/diverging nozzle, a loop or cyclone at the low pressure region of the venturi or nozzle and means for injecting fluid into the gas stream at said loop or cyclone.

BRIEF DESCRIPTION OF THE DRAWINGS

To more fully describe the invention reference will be made to the accompanying drawings in which.

DESCRIPTION OF THE PREFERRED EMBODIMENTS

The source of heated air is preferably derived from waste heat sources such as for example the waste gas from a boiler or alternatively from a solar heater. The heated air, which is relatively dry and near atmospheric pressure is introduced into the nozzle of a venturi directly into a loop or cyclone.

Figure 1:
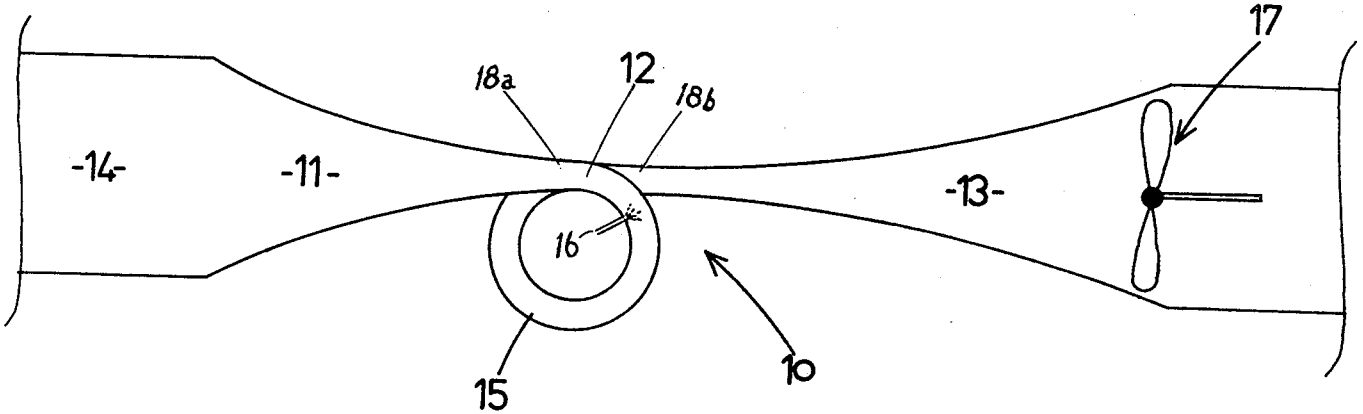
FIG. 1 is a schematic elevation view of one form of the invention.

Referring firstly to FIG. 1 of the drawings the venturi 10 has a nozzle 11, a throat 12 and a diffuser 13. A conduit portion 14 is shown which couples nozzle 11 to the heat source (not shown). The throat portion 12 includes a loop 15 which communicates with nozzle 11 and diffuser 13 at junctures 18*a* and 18*b*, respectively, and is of the same cross sectional area as the throat so that the pressure of the air within the loop remains substantially constant and is equal to the pressure in the low pressure area or throat 12 where nozzle 11 joins loop 15, i.e. 18*a*.

Fluid injection means, not illustrated but shown generally at 16, is located in the upstream portion of loop 15 and permits the injection of fluid, typically water, with a high latent heat of evaporation into the air flow.

Air passing through nozzle 11 of the venturi 10 is thus expanded to a high velocity and low pressure. The relatively dry air thus has fluid injection by injection means 16 and the fluid and air are mixed during their passage through loop 15. The moist air thus issues from the downstream portion of throat 12 at high velocity, lower temperature, low pressure.

The resultant mixture thus passes through the diffuser 13 to issue at low velocity, higher temperature than that at the throat 12, and near atmospheric pressure. The issuing mixture thus passes through a turbine indicated at 17 thereby constituting the work portion of the cycle. The turbine 17 can be replaced by other expansion means or used as increased gas pressure.

Downstream of turbine 17 all fluid injected in the loop 15 is removed by say evaporation, by venting to atmosphere, or by a heat exchanger so as to recover the coolant. The air can thus be returned to the heat source for heating.

The machine may also incorporate conventional expansion and compression turbines in the system since the pressure ratio of the venturi may be limited by sonic effects if a greater pressure ratio is required.

Figure 2:
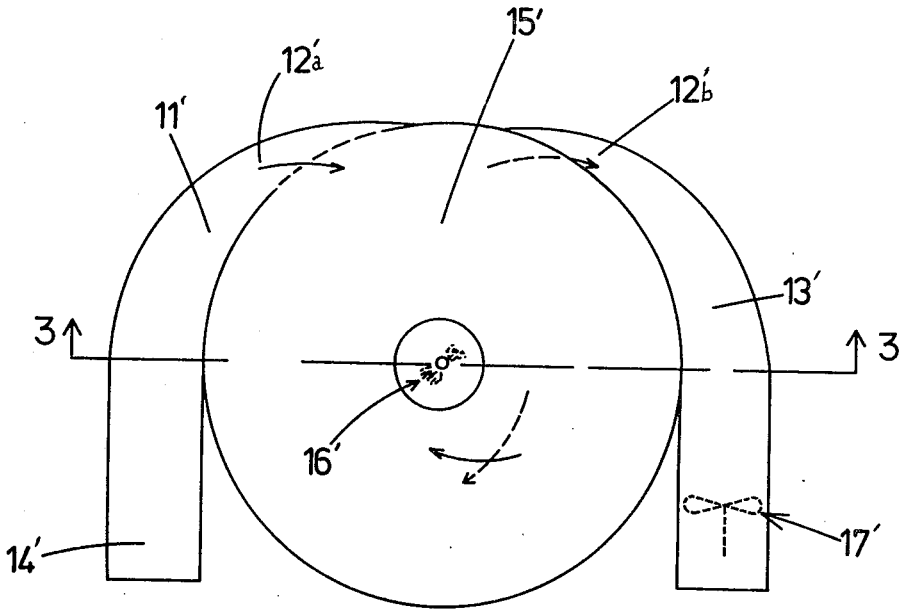
FIG. 2 is a schematic elevation view of a second form of the invention.
Figure 3:
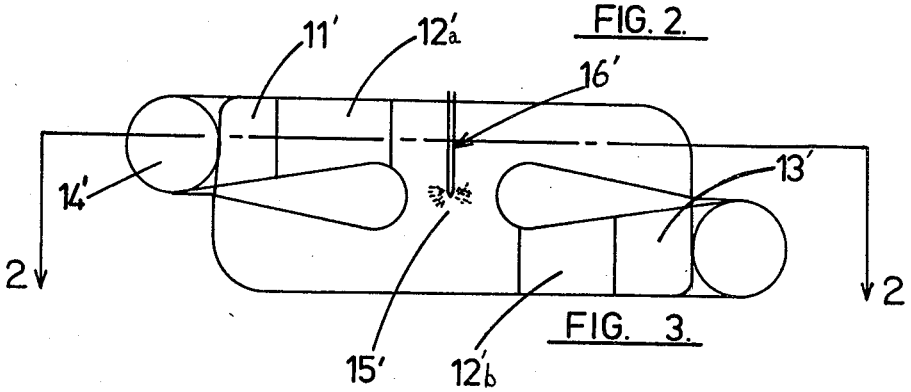
FIG. 3 is a cross-sectional view of the invention as illustrated in FIG. 2.

Referring to FIGS. 2 and 3 an alternative embodiment is shown. The loop portion 15 of the embodiment shown in FIG. 1 is replaced by a cyclone 15' and the entry 12'*a* and exit thereto are coupled to a nozzle portion 11' and diffuser 12*b* portion 13'; respectively. The injection means 16' is formed by a nozzle which is coaxial with cyclone 15' as more clearly shown in FIG. 3. The cyclone 15' could provide the expansion and compression means on its own rather than purely a replacement for loop portion 15. The vortices generated in the cyclone can also give a similar expansion and compression effect as the venturi due to the centrifugal forces generated.

Fluid injections at 16 or 16' would typically be at high pressure to minimise mixing losses (also parallel to gas flow as much as possible). The loop illustrated in FIG. 1 is only recommended for mixing purposes and may be only a bend or even eliminated.

Throughout this disclosure reference has been made to the working medium as air but it will be appreciated by those skilled in the art that other gases could be used if desired.

What is claimed is:

1. In a method of operating a heat engine including the steps of compressing, heating, expanding and cooling a gas, the improvement comprising:

(a) introducing a previously heated gas into a convergent portion of a fluid flow passage of said heat engine to effect expansion of the gas;

(b) cooling the previously heated gas by injecting a fluid into the fluid flow passage after it has been expanded by the convergent portion;

(c) compressing the now cooled mixture of gas and injected fluid by passing said mixture through a divergent portion of said fluid flow passage; and (d) conducting said mixture to a working area.

2. The method according to claim 1 wherein the heated gas is heated by means of a solar heater.

3. The method according to claim 1 wherein the heated gas is derived from a waste heat source.

4. The method according to claim 1 wherein the injected fluid is recovered after passage of the mixture of gas and injected fluid through said working area.

5. The method according to claim 1, wherein the fluid flow passage comprises a cyclone.

6. The method according to claim 1, wherein the fluid flow passage comprises a venturi, within the throat portion of which and between the convergent and divergent portions thereof is located a constant pressure loop.

7. The method according to claim 1, wherein the fluid flow passage in which said fluid is injected is a constant pressure loop.

8. In a heat engine including means for heating a gas, means for expanding a gas, means for cooling a gas and means for expanding a gas, the improvement comprising a fluid flow passage coupled by conduit means to said heating means, said fluid flow passage further comprising a convergent portion in communication with said conduit means for dynamically expanding the heated gas; a low pressure region of said fluid flow passage communicating with and downstream of said convergent portion; means for injecting a coolant fluid into the heated gas in said low pressure region for cooling the heated gas; a divergent portion communicating with said low pressure region for compressing the now cooled mixture of fluid and gas; and conduit means communicating with said divergent portion for directing the cooled mixture of fluid and gas to a working area.

9. The heat engine according to claim 8 wherein the heating means comprises a solor heater.

10. The heat engine according to claim 8 wherein the heating means comprises a waste heat source.

11. The heat engine of claim 8, wherein the fluid flow passage comprises a cyclone.

12. The heat engine of claim 11, wherein a turbine is disposed in said working area.

13. The heat engine of claim 8, wherein the fluid flow passage comprises a venturi.

14. The heat engine of claim 13, wherein a turbine is disposed in said working area.

15. The heat engine of claim 12 or 14, wherein a heat exchanger is provided downstream of the turbine to extract the coolant fluid.

16. A heat engine according to claim 13, wherein said venturi comprises a loop having two ends, one end of said loop communicating with a first throat having two ends, the second end of said first throat communicating with the convergent portion of said fluid flow passage, the second throat having two ends, the second end of said second throat communicating with the divergent portion of said fluid flow passage, said throats and said loop having the same cross-sectional area.

* * * * *